US011553749B2

(12) United States Patent
Cristaldi

(10) Patent No.: US 11,553,749 B2
(45) Date of Patent: Jan. 17, 2023

(54) SARTORIAL AND/OR INDUSTRIAL DESIGN AND METHOD FOR MANUFACTURING SAID SARTORIAL AND/OR INDUSTRIAL DESIGN

(71) Applicant: Teresa Cristaldi, Martina Franca (IT)

(72) Inventor: Teresa Cristaldi, Martina Franca (IT)

( * ) Notice: Subject to any disclaimer, the term of this patent is extended or adjusted under 35 U.S.C. 154(b) by 0 days.

(21) Appl. No.: 17/281,932

(22) PCT Filed: Oct. 22, 2019

(86) PCT No.: PCT/IB2019/059012
§ 371 (c)(1),
(2) Date: Mar. 31, 2021

(87) PCT Pub. No.: WO2020/084486
PCT Pub. Date: Apr. 30, 2020

(65) Prior Publication Data

US 2021/0378338 A1 Dec. 9, 2021

(30) Foreign Application Priority Data

Oct. 23, 2018 (IT) ..... 102018000009722

(51) Int. Cl.
*A41D 27/24* (2006.01)
*A41H 3/00* (2006.01)

(52) U.S. Cl.
CPC ..... *A41H 3/00* (2013.01); *A41D 27/24* (2013.01); *A41D 2300/50* (2013.01)

(58) Field of Classification Search
None
See application file for complete search history.

(56) References Cited

U.S. PATENT DOCUMENTS 2,333,155 A 11/1943 Dorfman
2,417,473 A 3/1947 Dorfman
9,107,462 B1 8/2015 Heinrich et al.

FOREIGN PATENT DOCUMENTS

WO 2009022883 A2 2/2009

OTHER PUBLICATIONS

International Search Report and Written Opinion dated Jan. 27, 2020 for PCT/IB2019/059012 to Teresa Cristaldi filed Oct. 22, 2019.

*Primary Examiner* — Alexander S Thomas
(74) *Attorney, Agent, or Firm* — Vorys, Sater, Seymour and Pease LLP

(57) ABSTRACT

A sartorial and/or industrial design is provided that is suitable for defining an item of clothing made exclusively from natural-type fibres for a user and including at least one main portion including fabric arranged in straight grain with respect to the body of the user and a secondary portion including a fabric arranged bias-wise with respect to the body of the user that is arranged in an area of the body subject to higher traction than the rest of the body and essentially shaped like at least part of the area of the body.

10 Claims, 5 Drawing Sheets

*Fig. 2a*
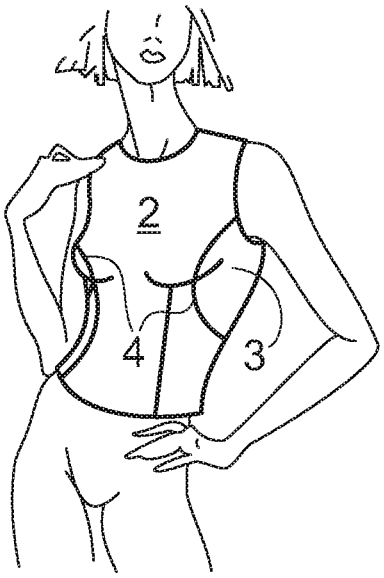
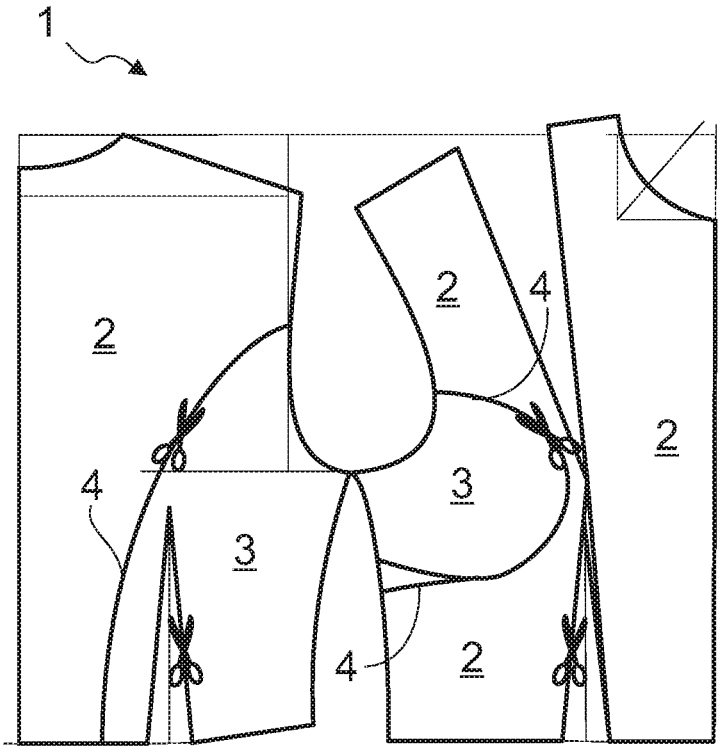
*Fig. 2b*
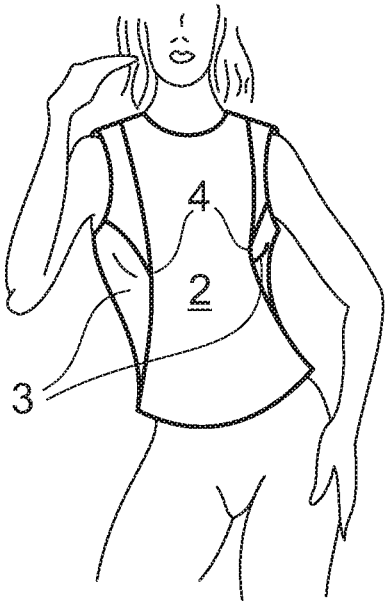
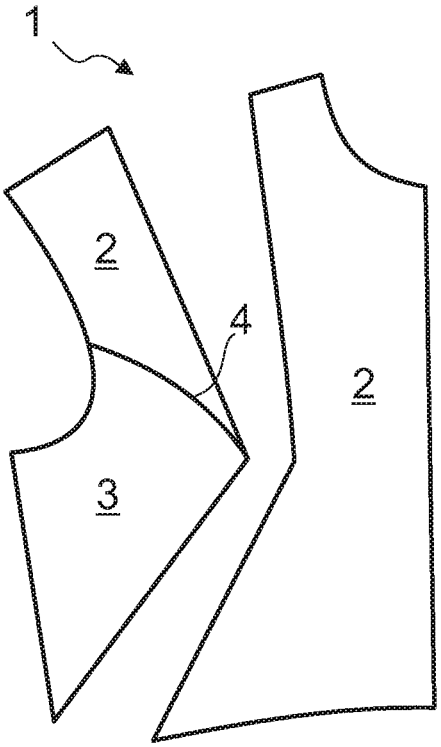
*Fig. 3b*
*Fig. 3a*

SARTORIAL AND/OR INDUSTRIAL DESIGN AND METHOD FOR MANUFACTURING SAID SARTORIAL AND/OR INDUSTRIAL DESIGN

FIELD OF THE INVENTION

This invention concerns a sartorial and/or industrial design and a method for manufacturing said sartorial and/or industrial design.

In particular, this invention has as its object a sartorial and/or industrial design suitable for adhering to the human body that may consist in items of clothing for men, women, and children such as, for example, jackets, shirts, trousers, jeans, dresses, bras, and the like.

DESCRIPTION OF THE PRIOR ART

As is known, in the field of sartorial and/or industrial designing of fashion in general, a plurality of items of clothing are made, each one having a shape that is usually standardised.

For centuries, and precisely since 1700, the mannequin for tailors has been the cornerstone for constructing the design and the shape of items of clothing. Each garment was, in fact, adapted to the shapes and posture of the mannequin. Jackets, in particular, were designed without taking into account the real movements that the limbs may make. Even today, it is common to create jackets, and many other items of clothing, using the figure of the mannequin, which is very far from the reality of the human body's dynamics. Before the 18th century, it was common to make clothes directly on the body of the customer, but with major drawbacks for practicality and comfort.

In particular, in fact, tailors used to make items of clothing with fibres exclusively arranged in straight grain, i.e. cut perpendicularly to the lateral edges of the cloth with consequent limitations on the users' ease of movement. Providentially between 1917 and 1939, Madeleine Vionnet, a French dressmaker, applied the bias cut to the whole dress giving women an unparalleled gift: practicality. Perhaps for the first time in the history of fashion, the female figure was free in its movements and it was possible to guess the natural physiognomy of the person.

Its discovery was revolutionary, even though it entailed many limitations and drawbacks, comprising a great waste of fabric and very irregular seams on the sides.

Later on, in France and America, draping schools were born, which provided for the design and creation of an item of clothing completely on the mannequin.

The schools of sartorial and industrial design were, therefore, established, and the consequent mathematical and geometric calculation on a flat paper surface. The dress was, therefore, cut either all in straight grain or all bias-wise, resulting in a rigid and uncomfortable garment that "boxed" and constrained any natural movement.

To date, these schools of thought are commonly adopted in the industrial field and define the so-called schools of sartorial and/or industrial design.

These schools involve the use of calculation, and of mathematical and geometric skills, on a flat surface such as a paper pattern.

The dress is usually cut either all in straight grain or all bias-wise. Therefore, the garments cut in straight grain are very rigid and often uncomfortable.

In short, each garment is, in fact, adapted to the shapes and postures of the mannequin with portions of unidirectional fabric, i.e. cut all in straight grain or all bias-wise, but often using non-natural fibres to ensure sufficient elasticity of the dress.

The prior art described comprises some significant drawbacks.

In particular, the sartorial and industrial designs currently conceived do not allow sufficient elasticity and strength in certain predetermined areas, such as the buttocks and shoulders. The elasticity is partially guaranteed by the conformation of the fibres that are mainly non-natural. The reason for this choice is that the elastic fibres, mainly derived from oil, allow greater deformations of the fabric.

The latter are, however, extremely harmful to people and polluting to the environment.

In addition, it is necessary to make fabrics with unidirectional fibres because it is not possible to make seams at points of the design where the portions of fabric have fibre directions oriented differently.

Moreover, the prior art currently does not enable the sartorial design to conform to the user's body, but only enables the fabric to be adapted, with difficulty, to the obviously completely static mannequin.

In fact, another important drawback is due to the fact that the garments made according to the current state of the art, do not enable the user to move freely within the dress, but tend to limit the dynamism of the same.

As a consequence of the above-mentioned characteristic, an additional drawback is due to the fact that the garments conceived with the current tradition are often subject to easy breakages owing to the low elasticity of the fabrics and to the stress that the constant movements of the body instil in the fibres.

SUMMARY OF THE INVENTION

In this situation, the technical task underlying this invention is to devise a sartorial and/or industrial design and related method for manufacturing said sartorial and/or industrial design, which is capable of substantially overcoming at least some of the above-mentioned drawbacks.

Within the scope of said technical task, it is an important aim of the invention to obtain a sartorial and/or industrial design and related manufacturing method that enables to easily model the final garment on the body of the user for whom it is intended, allowing it to be adapted to the natural shapes of the underlying muscle and to the shapes of the wearer without eliminating comfort.

Another important aim of the invention is to make designs that do not limit the dynamism of the user and that are able to facilitate the movements and deformations owing, for example, to muscle movement, while giving, at the same time, three-dimensionality to the garment itself.

In conclusion, another important task of the invention is to make a design that is very resistant even to the wide movements of the user who wears the garment.

The technical task and the specified aims are achieved by a sartorial and/or industrial design and a method for manufacturing said sartorial and/or industrial design in accordance with one or more embodiments described herein.

Preferred embodiments are described in the dependent claims.

BRIEF DESCRIPTION OF THE DRAWINGS

The characteristics and benefits of the invention will be clarified in the following detailed descriptions of some preferred embodiments of the invention, with reference to the accompanying drawings, wherein:

FIG. 2*a* illustrates an example of a sleeveless bodice made with a sartorial or industrial design, according to the invention, and worn by a user;

FIG. 2*b* is a paper pattern of the sartorial or industrial design, according to the invention, worn by a user in FIG. 2*a;*

FIG. 3*a* is a second example of a sleeveless bodice made using a sartorial or industrial design, according to the invention, and worn by a user;

FIG. 3*b* shows a paper pattern of the sartorial or industrial design, according to the invention, worn by a user in FIG. 3*a;*

Figure 1:
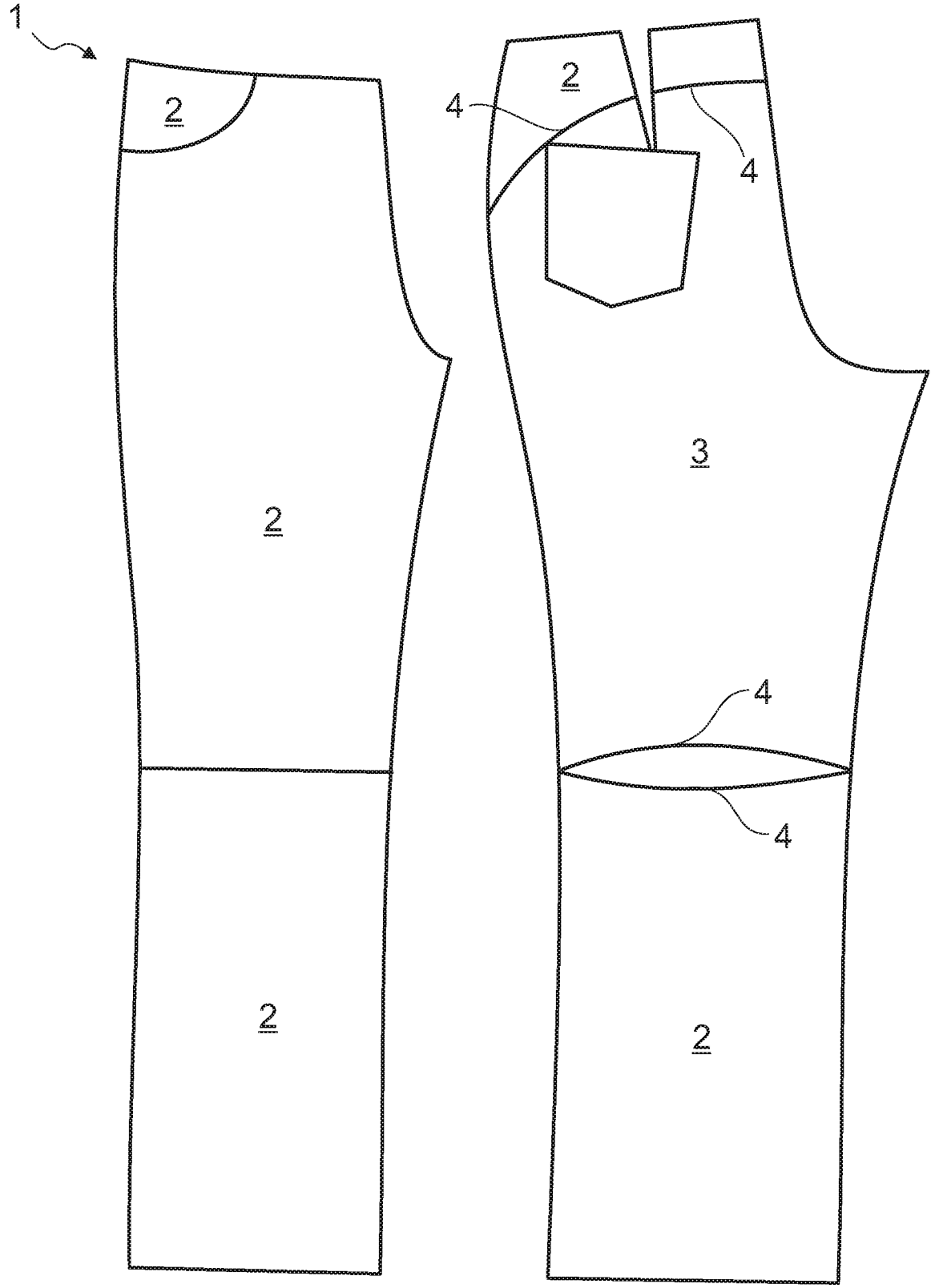
FIG. 1 shows an example of a sartorial or industrial design, according to the invention, suitable for making a pair of trousers.
Figure 4:
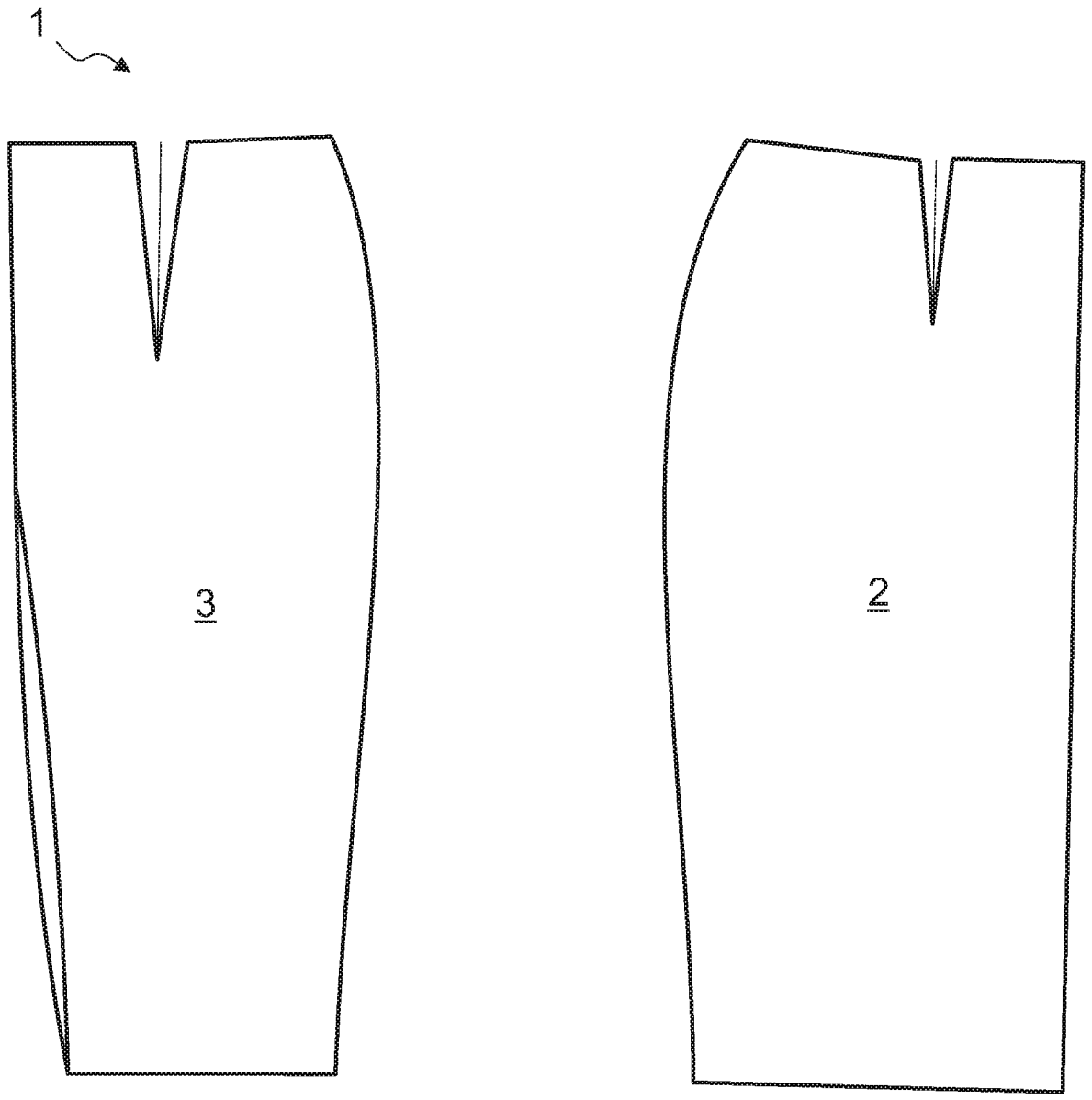
FIG. 4 illustrates an example of a sartorial or industrial design according to the invention suitable for making a skirt.

In this document, the measures, values, shapes, and geometric references (such as perpendicularity and parallelism), when associated with words like "about" or other similar terms such as "approximately" or "essentially", are to be understood as except for measurement errors or inaccuracies owing to production and/or manufacturing errors and, above all, except for a slight divergence from the value, measure, shape, or geometric reference with which it is associated. For example, these terms, if associated with a value, preferably indicate a divergence of not more than 10% of the value.

Furthermore, when used, terms such as "first", "second", "higher", "lower", "main" and "secondary" do not necessarily identify an order, a priority relationship, or a relative position, but can simply be used to more clearly distinguish between the different components.

The measurements and data contained in this text are to be considered, unless otherwise indicated, as carried out in ICAO International Standard Atmosphere (ISO 2533:1975).

DESCRIPTION OF THE PREFERRED EMBODIMENTS

With reference to the figures, the sartorial and/or industrial design according to the invention is indicated as a whole by the numeral 1.

The sartorial and/or industrial design 1 is preferably suitable for being subsequently transformed into a genuine item of clothing. Therefore, the term sartorial and/or industrial design 1 may not refer exclusively to the paper pattern, but may refer directly to the dress, each portion of the paper pattern being essentially a coding on paper of what corresponds to a part of a dress on a mannequin or on a user.

The sartorial and/or industrial design 1 is to be understood, therefore, as a similarity, on paper, of an item of clothing.

Therefore, the design 1 can be of any type and gender. It can be or can enable the making of a sports outfit or an evening dress, for example a high fashion one, and can comprise a plurality of different types of cut.

The design 1 can refer to a pair of trousers, a jacket, a skirt, a shirt or other types of garments without any limitation.

In particular, the design 1 is preferably intended for a user and is suitable for covering at least part of the body of said user. The item of clothing or design 1 preferably covers at least most of the lower portion of the body and/or the upper portion of the body.

The lower portion of the body means the groin area and the lower limbs, while the upper area means the torso and the upper limbs.

The design 1 preferably includes at least one main portion 2. The main portion may comprise one or more pieces, or one or more fabrics, in which the fibres are arranged in straight grain. The term "straight grain" is a sartorial term and essentially indicates that the fabric that composes the design includes fibres arranged along a single direction that is oriented essentially parallel or perpendicular to the direction of stress that leads to the deformation of the fabric.

In addition, the design 1 should preferably comprise one or more secondary portions 3.

Each of the secondary portions 3 preferably defines a piece of fabric with its own perimeter that delimits an area. Furthermore, since the secondary portions 3 are preferably obtained from a predetermined design, they are, together with the main portion(s) 2, suitable for covering the areas of the body for which the design 1 is intended. The secondary portions 3 are not parts of fabric to be superimposed on the other parts of the fabric in straight grain, but are parts of fabric that replace the parts in straight grain in the corresponding area. Therefore, the design 1 is essentially defined by a puzzle of main portions 2 and secondary portions 3.

The area of each secondary portion 3 is preferably compatible with the user's body area for which it is intended. The term compatible means, in particular, that the secondary portion 3 is essentially shaped like at least part of the area of the body on which it is placed.

Figure 5:
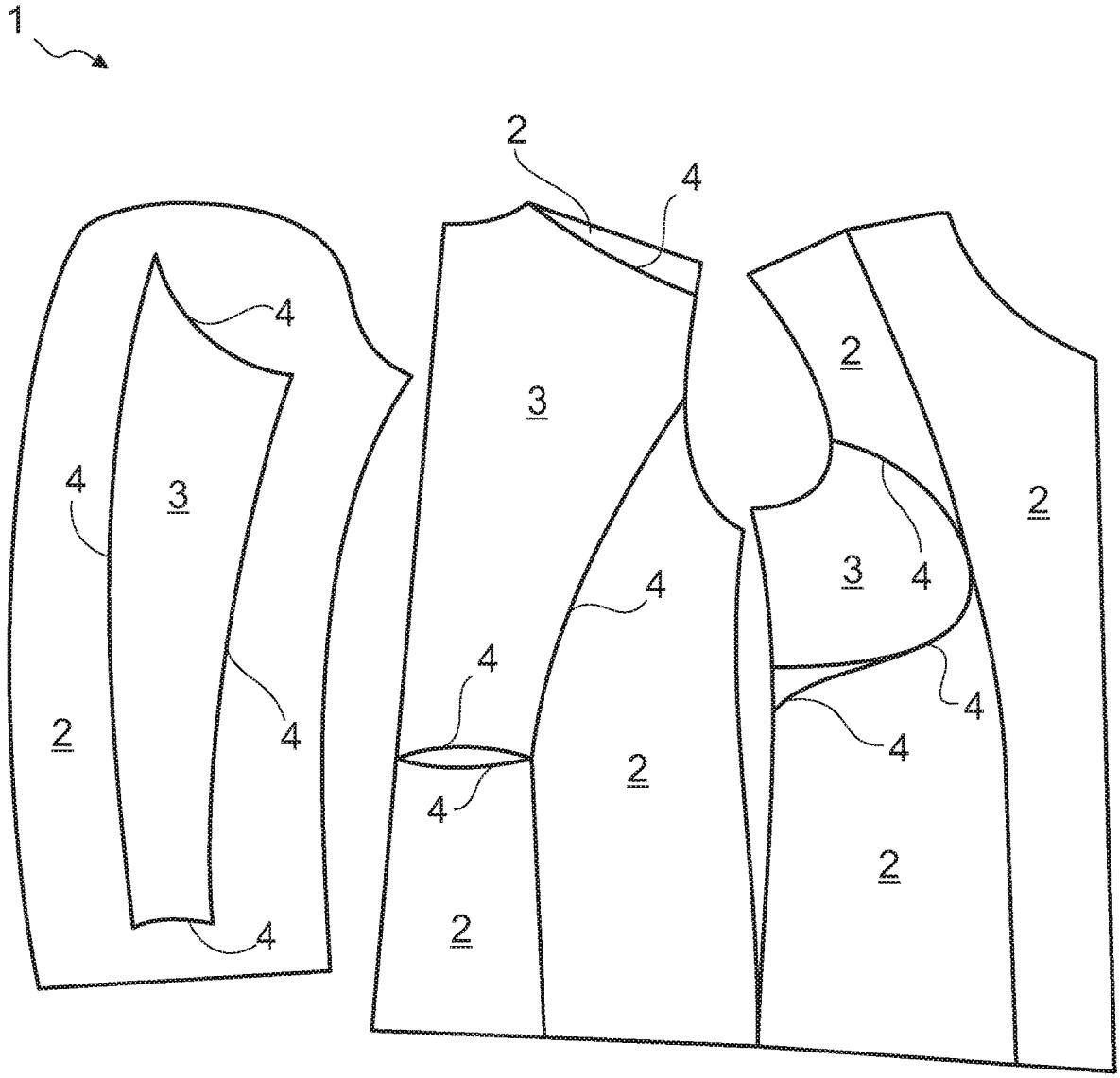
FIG. 5 is an example of a sartorial or industrial design according to the invention suitable for making a jacket in which the particular arrangement, conforming to the area of the user's body, of the secondary bias-wise portions are even more evident.
Figure 6:
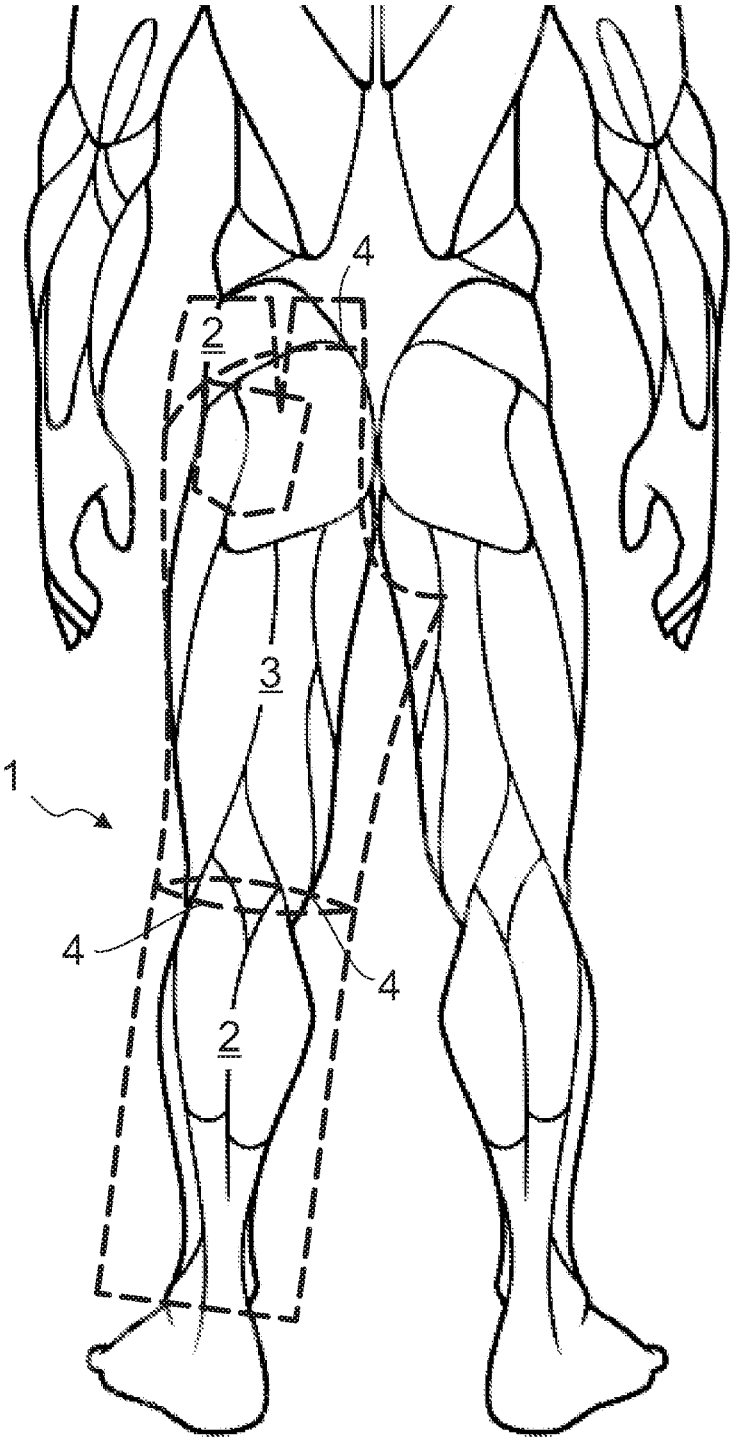
FIG. 6 represents the sartorial or industrial design of FIG. 1 superimposed on a human body model in which the substantial overlap between the sewing lines and the perimeter of the muscle groups is clearly seen, in particular the left buttock and biceps femoris, as well as between the secondary portion and the area of the body delimited by said muscle groups.

For example, the secondary portion 3 can be placed on the buttocks, and does not extend to the whole rear portion of the trousers, but preferably only at the muscle capable of performing the greater deformation, getting deformed, as shown in FIG. 5. In essence, the secondary portion 3 is arranged and conformed on the basis of specific groups of muscle bundles. The secondary portion 3 is preferably placed on the areas of the body subject to the largest deformations, which are known to the person skilled in the art and which correspond to the areas where the fabric is exposed to greater traction, i.e. where it is "pulled" more when a user makes common movements such as walking, sitting, lifting arms, and the like. These areas are preferably the buttocks area, the lower arm area, the lateral bust area, the underarm area, and the top part of the back.

The secondary portions 3 appropriately include bias fibres.

The term "bias-wise" is a sartorial term that indicates a portion of fabric in which the fibre is arranged essentially at 45° to the direction of the strain, i.e. of the forces that lead to the deformation of the portion of fabric.

Therefore, the design 1 may include secondary portions 3 arranged in the most disparate areas. Taking a jacket as an example, the secondary portions 3 and main portions 2 can be arranged in such a way that the design 1 has a configuration of this type: the main portions 2 are, preferably, at the centre, the front, and the upper sleeve; the lateral and underarm swatch preferably include secondary portions 3. If, on the other hand, the design 1 refers to a skirt, the back is made up of one or more secondary portions 3, while the front is made up of one or more main portions 2. A pair of trousers, preferably, includes the front and back waist with main portions 2, the buttocks with secondary portions 3 up to the knee, and the rest is made with main portions 2.

The front strap may include a secondary portion 3, the back strap a main portion 2. As far as the sleeves are concerned, the sleeve may include a secondary portion 3 below and a main portion 2 above.

Generalizing the concept, as already mentioned above, the design 1 appropriately comprises at least one main portion 2 suitable for making the shape of an item of clothing and at least one secondary portion 3 at an area of the human body subject to larger deformations.

The areas of the body subject to the largest deformations are obvious and correspond to the areas in which the fabric is exposed to greater traction, i.e. where it is "pulled" more when a user performs common movements such as walking, sitting, raising the arms, and the like.

These areas are preferably the buttocks area, the lower arm area, the lateral bust area, the underarm area, and the top part of the back.

In order to be able to make the design 1, it is not possible, as already mentioned in the discussion of the prior art, to use conventional stitching.

The design 1 appropriately comprises particular sewing lines 4.

The sewing lines 4 are not straight, but preferably describe curved trajectories. In particular, they describe the trajectories that are suitable for enabling the joining of the main portions 2 and the secondary portions 3 in such a way that the fibres of each portion 2, 3 are continuously united, as shown in FIG. 3.

If straight seams are used, the fibres would be staggered, and the item of clothing would assume irregular deformations during movement that would lead to stitches that are not aesthetically satisfactory and that are uncomfortable for the user. Furthermore, the sewing lines 4 preferably follow at least part of the perimeter identified by the area of the body on which a secondary portion 3 is placed. As clearly shown in FIG. 5, in fact, for example, the sewing line 4 at the rear top part of the pair of trousers, follows the perimeter defined by the buttock.

The sewing lines 4 can, between the portions 2, 3 be essentially counter-shaped, or can be configured, at least in part, to produce an opposing curvature, or double curvature. Preferably, at least part of said sewing lines 4 unites a main portion 2 and a secondary portion 3 that face the sewing line 4 defining opposing curvatures with cavities turned towards the sewing line 4.

This double curvature is preferably defined at areas of the body 10 that are particularly exposed to large and sudden deformations, particularly of compression, such as the back area of the trousers, for example clearly shown in FIG. 1, the side area of the upper bust of any garment and jacket, for example shown in FIG. 2*b* and FIG. 5, and the lower area of the back of a jacket, as shown in FIG. 5.

The design 1 is therefore suitable for making an item of clothing the fibres of which are entirely natural. These fibres are notoriously non-elastic, but the configuration of the secondary portions 3 enables these types of fibres to be used. Such fibres may include materials such as wool, cotton, silk, cashmere, linen, rayon, viscose, and other fibres, as long as they are natural and non-elasticised.

Moreover, preferably, if the item of clothing made with the sartorial and/or industrial design 1 includes a plurality of secondary portions 3, none of the secondary portions 3 is attached, through the sewing line 4, to another secondary portion 3 along the same side of the said item of clothing, in such a way as to avoid uncontrolled deformations.

Essentially, therefore, each secondary portion 3 arranged on the same side is preferably surrounded only by main portions so that it is not possible, for the fabric, to define humps in an unwanted manner.

The invention comprises, in particular, a new method for manufacturing a sartorial and/or industrial design 1 for clothing.

The method comprises, in particular, at least one definition step in which the sartorial and/or industrial design 1 is carried out on a paper pattern. During this step, preferably, the design 1 only includes one main portion 2 the perimeter of which defines the shape of an item of clothing and, in part, the sewing areas that, subsequently, enable the garment to be made.

In addition, the method comprises at least one fragmentation step in which at least one said secondary portion 3 is drawn, at the areas of the body associated with larger deformations, essentially shaped like at least part of the area of said body. The secondary portions 3 are appropriately delimited by sewing lines 4 with respect to the main portions 2 in such a way that the boundaries between the two are curved and allow the correct alignment of the fibres.

Moreover, as already mentioned, the same side of the item of clothing is preferably made in such a way that, if there is more than one secondary portion 3, none of them are connected, through the sewing lines 4, to another of the secondary portions 3. In fact, it is better that the secondary portions 3 are always separated to avoid any uncontrolled deformation.

In particular, the sartorial and/or industrial design 1 developed using the method described above comprises, depending on the item of clothing, the same characteristics as those described in the previous pages.

The sartorial and/or industrial design and the method for manufacturing said design according to the invention achieve significant advantages.

In fact, the configuration of the designs 1 enables the item of clothing resulting from the design 1 itself to be easily modelled on the body of the user for whom it is intended.

In particular, depending on the musculature of the body, it is possible to place the secondary portions 3 in such a way that any movement of muscle areas such as the shoulders and biceps are not restricted by the fabric.

In fact, if you take a square of common cloth in your hand, it is easy to see that the way in which it deforms under a tensile stress is highly dependent on the direction in which it is pulled. If you pull, with a certain accuracy, along the threads of the warp and the weft, i.e. in straight grain, the cloth stretches very little and, in other words, it is rigid to traction. On the contrary, by applying traction to the fibres bias-wise, the deformation is much greater.

In this sense, an important advantage of the design 1 and method is to make items of clothing that do not limit the dynamism of the user who uses them and that is not subject to easy breakage owing to the limited deformations that the garment can withstand.

In conclusion, an important advantage of the invention is that of enabling elastic designs 1 to be made using only natural fibres. The fact that it is possible to make elastic garments with natural fibres considerably reduces pollution that is harmful to people and to the environment.

The invention is susceptible of variations falling within the scope of the inventive concept as defined by the claims.

In this context, all details can be replaced by equivalent elements, and the materials, shapes, and dimensions may be any materials, shapes, and dimensions.

The invention claimed is:

1. A sartorial or industrial design suitable for defining an item of clothing made exclusively from natural fibres for a human body of a user and comprising at least one main portion including fabric suitable to be arranged in straight grain with respect to the human body, and one secondary portion including a fabric suitable to be arranged bias-wise with respect to said human body, arranged in an area of said human body subject to higher traction than the rest of said human body and substantially shaped like at least part of said area of said human body, wherein said secondary portion and said main portion are joined together by means of a respective sewing line describing a curved trajectory in such a way that the fibres of said portions are joined together continuously, and wherein at least part of said respective sewing line unites one said main portion and one said secondary portion that face said sewing line defining opposing curvatures with cavities turned towards said respective sewing line.

2. The design according to claim 1, wherein said respective sewing line follows at least part of the perimeter identified by said area of said human body on which said secondary portion is suitable to be arranged.

3. The design according to claim 1, comprising a plurality of said secondary portions and in which none of said secondary portions is attached, by means of said respective sewing line, to another of said secondary portions along the same side of said item of clothing, in such a way as to avoid uncontrolled deformations.

4. The design according to claim 1, comprising a plurality of secondary portions and suitable for making an upper bust of any garment in which said secondary portions are suitable to be arranged at each of the two underarms and two rear sides of said human body and said main portion defines the rest of said body.

5. The design according to claim 1, suitable for making a skirt wherein said secondary portion is suitable to be arranged at the rear of said human body and said main portion is suitable to be arranged at the front of said human body.

6. The design according to claim 1, suitable for making a pair of trousers wherein said secondary portion is suitable to be arranged at the legs area of said body between the buttocks and knees and said main portion is arranged at the rest of said human body.

7. The design according to claim 1, suitable for making a jacket wherein said secondary portion is arranged at the top part of the back of said human body.

8. The design according to claim 1, wherein the fibers are non-elastic.

9. The design according to claim 1, wherein the fibers are selected from at least one of wool, cotton, silk, cashmere, linen, rayon, and viscose.

10. The design according to claim 1, wherein the fibers are selected from at least one of wool, cotton, silk, cashmere, and linen.

* * * * *